US009878895B2

(12) United States Patent
Young

(10) Patent No.: US 9,878,895 B2
(45) Date of Patent: Jan. 30, 2018

(54) TEST PORT FOR FUEL DISPENSER

(71) Applicant: Gregory E. Young, Prescott Valley, AZ (US)

(72) Inventor: Gregory E. Young, Prescott Valley, AZ (US)

( * ) Notice: Subject to any disclaimer, the term of this patent is extended or adjusted under 35 U.S.C. 154(b) by 601 days.

(21) Appl. No.: 14/459,834

(22) Filed: Aug. 14, 2014

(65) Prior Publication Data

US 2016/0047507 A1 Feb. 18, 2016

(51) Int. Cl.
*B67D 7/04* (2010.01)
*B67D 7/32* (2010.01)

(52) U.S. Cl.
CPC ..... *B67D 7/04* (2013.01); *B67D 7/3209* (2013.01); *B67D 7/3218* (2013.01)

(58) Field of Classification Search
CPC ..... B67D 7/04; B67D 7/3218; B67D 7/3209; F16L 41/03
USPC ..... 285/125.1
See application file for complete search history.

(56) References Cited

U.S. PATENT DOCUMENTS 30,678 A * 11/1860 Holly ..... F16L 37/091 285/148.1
2,441,204 A * 5/1948 Nusbaum ..... B65B 31/003 285/125.1
2,598,961 A * 6/1952 Andrus ..... A01G 25/02 137/883
2,650,556 A * 9/1953 Turner ..... A01C 23/024 285/125.1
2,663,325 A * 12/1953 Bede ..... B05B 7/1606 285/125.1
2,747,604 A * 5/1956 Fraser ..... F16K 11/0565 137/360
3,570,534 A * 3/1971 Beavers ..... B60T 11/24 285/125.1
3,736,955 A * 6/1973 Schlesser ..... F15D 1/0005 285/125.1
4,230,347 A * 10/1980 Williams ..... F16L 41/086 285/125.1
4,649,970 A * 3/1987 Bower ..... B67D 7/048 137/909
4,821,559 A * 4/1989 Purpora ..... G01M 3/2892 138/90
4,872,490 A 10/1989 Geisinger
4,966,190 A 10/1990 Geisinger
(Continued)

*Primary Examiner* — David E Bochna
(74) *Attorney, Agent, or Firm* — Von Hellens & Bycer Law; Matthew L. Bycer

(57) ABSTRACT

A permanent test port mounting in a conventional gasoline/diesel fuel dispenser to provide a technician access to the fuel line and perform various tests that enables testing to occur at a highline point in the line system to include all or at least more of the line system head pressure than has been possible before. In particular, the test port has a quick connect/disconnect fitting disposed in a collar intermediate a mounting for a filter in a conventional gasoline/diesel fuel dispenser and the filter to provide a technician access to the fuel line and perform various tests. The quick connect/disconnect fitting may also be coupled to a hose for draining fuel under pressure into a safety can to prevent spillage during replacement of the filter. The safety can may be emptied into the fuel tank to conserve the fuel, prevent polluting the environment and as a safety measure.

22 Claims, 5 Drawing Sheets

(56) References Cited

U.S. PATENT DOCUMENTS

| | | | | | |
|---|---|---|---|---|---|
| 5,042,290 | A | | 8/1991 | Geisinger | |
| 5,090,740 | A | * | 2/1992 | Creager | F16L 41/03 285/125.1 |
| 5,157,958 | A | | 10/1992 | Geisinger | |
| 5,176,177 | A | * | 1/1993 | Rupp | A62C 33/00 285/125.1 |
| 5,203,384 | A | * | 4/1993 | Hansen | B67D 7/0478 285/125.1 |
| 5,253,807 | A | * | 10/1993 | Newbegin | A01G 25/023 239/11 |
| 5,695,225 | A | * | 12/1997 | Grenga | F16L 41/02 285/125.1 |
| 5,908,055 | A | * | 6/1999 | Baumann | B67D 7/0476 141/100 |
| 6,269,678 | B1 | | 8/2001 | Geisinger | |
| 6,363,962 | B1 | | 4/2002 | Geisinger | |
| 6,427,516 | B2 | | 8/2002 | Geisinger | |
| 6,604,548 | B2 | | 8/2003 | Geisinger | |
| 8,042,376 | B2 | * | 10/2011 | Yang | B67D 7/067 73/1.16 |
| 2005/0110271 | A1 | * | 5/2005 | Kusanagi | F02M 55/025 285/125.1 |
| 2013/0032248 | A1 | * | 2/2013 | Mitrovich | B67D 7/005 141/198 |
| 2015/0047715 | A1 | * | 2/2015 | Foster | B67D 7/3218 137/68.14 |

* cited by examiner

TEST PORT FOR FUEL DISPENSER

BACKGROUND OF THE INVENTION

1. Field of the Invention

The present invention relates to test ports and, more particularly, to test ports for use with conventional gasoline/diesel fuel dispensers.

2. Description of Related Prior Art

From time to time the pressurized line system found in conventional petroleum fueling sites, such as gasoline/diesel fuel pumps/dispensers. These fueling sites include a mechanical line leak detector that must be tested to ensure proper functioning. To test these detectors, access to the pressurized line system is necessary. Additionally, such access is required for general inspections and troubleshooting to determine the cause of a fault.

For safety reasons, every dispenser includes an impact/shear valve located slightly below grade beneath each fuel dispenser. The primary function of this valve is to stop the flow of pressurized fuel if the dispenser is struck or dislodged due to accident or otherwise. Because these valves are commonly made of soft cast metal any seam may split and any threads are easily stripped creating a need to replace these valves.

It is not unusual for a technician to obtain fluid communication with the pressurized line system by removing a plug from the impact/shear valve and inserting therein a test probe. By removing such a plug to gain access to the threaded opening in the impact/shear valve, fuel will be discharged as a function of the line pressure. This creates an obvious mechanical hazard for the technician, a fire hazard for the immediate environment, evaporation of the fuel degrades the air quality and the spilled fuel potentially creates ground or ground water pollution.

To reduce the line pressure by removing the plug requires good judgment and patience, if the plug is turned too many times to vent the line pressure, the plug may be sufficiently dislodged to become a projectile and potentially injuring a technician or surrounding personnel or objects. While many pressurized line systems have a high bulk modulus (rapid change of pressure for a relatively small amount of fuel), a significant number of pressurized lines have flexible lines, many flexible connectors, trapped vapor, or any combination thereof which may require thirty minutes or more to safely bleed the line to allow safe access to the line system. To avoid the hazards of removing a plug from the impact/shear valve, some technicians have replaced the plug with a quick connect fitting. A hose is attached thereto to drain fuel discharged from the pressurized line system into a container. While this solution avoids an inadvertent spray of fuel, other issues are created.

In an attempt to protect the quick connect valve, a cover is often employed. Nevertheless, the opening of the impact/shear valve to mount the quick connect fitting was always dangerous. Secondarily, the integrity of a quick connect fitting may be damaged during an impact to the gasoline/diesel fuel dispenser. With the integrity of the quick connect fitting compromised, their location provides an unfortunate flow path that defeated the purpose of the impact/shear valve supporting the damaged quick connect fitting. These damaged quick connect fittings have caused destruction of property and loss of life. Therefore, fire and safety personnel have precluded these quick connect fittings from being installed and often have required existing quick connect fittings to be removed. Thus, technicians have had to revert to removing a plug from the impact/shear valve to perform the required tests and the attendant safety hazards continue to exist.

SUMMARY OF THE INVENTION

The present invention is directed to an apparatus for locating a test port at a high line of entry in a conventional gasoline/diesel fuel dispenser for vehicles to reduce pressure in the line. A test port is threadedly engaged with a mounting for a standard fuel filter and includes a threaded boss for supporting the filter therebeneath. A quick connect fitting is threadedly engaged with the mounting and in communication with the fuel attendant the filter. The quick connect fitting serves as a pressure relief for testing a conventional mechanical line leak detector and for the first time, enables the leak detector to be tested with most if not all the actual head pressure present in the line system.

It is therefore a primary object of the present invention to enhance the accuracy of field testing of a line leak detector.

Another object of the present invention is to reduce the likelihood of spilled fuel during testing of a fuel line in a conventional gasoline/diesel fuel dispenser.

Another object of the present invention is to reduce the likelihood of spilled fuel during routine maintenance work including changing fuel filters in a conventional gasoline/diesel fuel dispenser.

Still another object of the present invention is to provide a test port in a collar in threaded engagement with the mounting for a filter in a conventional gasoline/diesel fuel dispenser and provide threaded support for such filter.

Yet another object of the present invention is to provide a test port in a collar disposed intermediate the fuel line of a conventional gasoline/diesel fuel dispenser and a filter for the fuel.

A further object of the present invention is to provide a ratchet operable fitting for threadedly engaging and disengaging a collar for a test probe with the mounting for a conventional filter in the fuel line of a conventional gasoline/diesel fuel dispenser.

A yet further object of the present invention is to manually stabilize a collar threadedly attached to a mounting in the fuel line of a conventional gasoline/diesel fuel dispenser during threaded engagement/disengagement of a filter with the collar.

A still further object of the present invention is to provide a test port for a conventional gasoline/diesel fuel dispenser at a location equal to the actual, or most of the actual head pressure generated by the static weight of the fuel.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
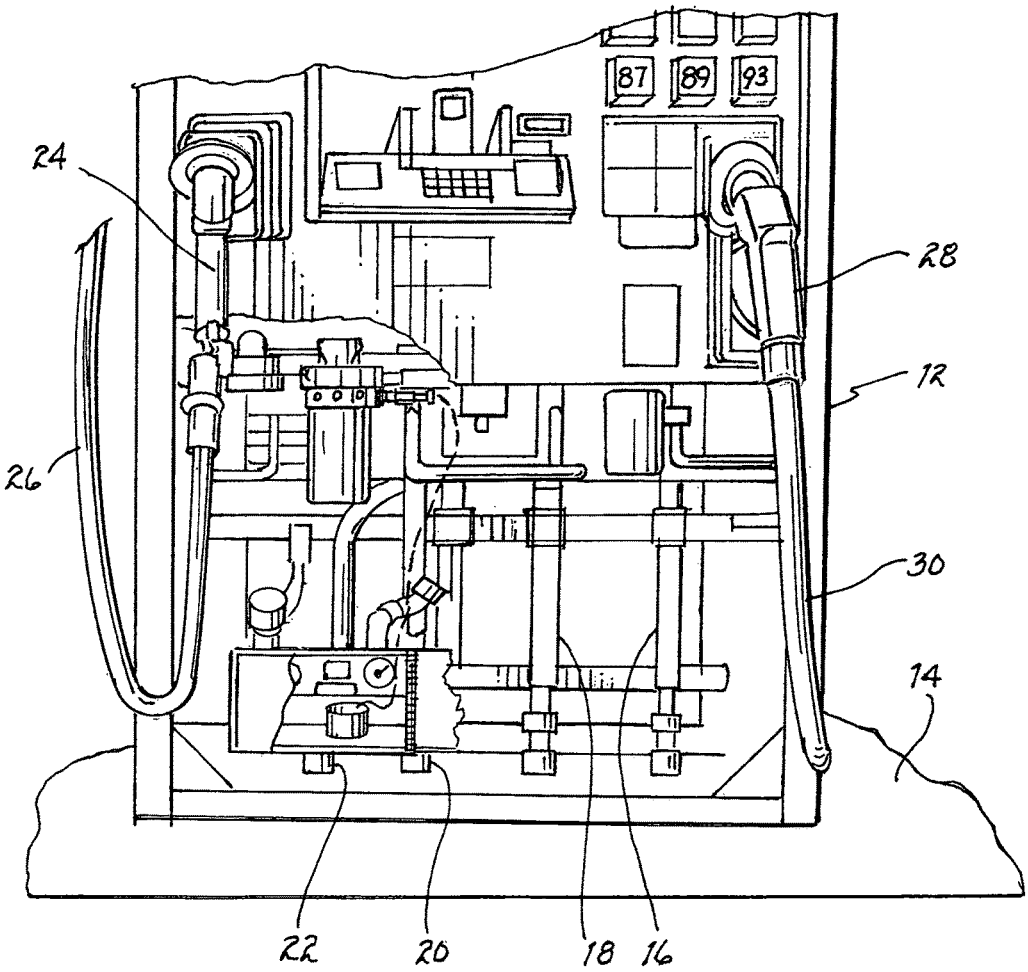
FIG. 1 illustrates some of the structure within a conventional gasoline/diesel fuel dispenser and particularly the location of a fluid filter supported from a collar embodying the present invention.

Referring to FIG. 1 there is a partial illustration of a conventional gasoline/diesel fuel dispenser. For purposes of clarity to describe the interaction of the present invention with the fuel flow through the dispenser, the interior of the dispenser is illustrated after removal of one or more front panels. Dispenser 10 includes a cabinet 12 secured to ground 14, which is usually of cement. A plurality of one or more pipes 16, 18, 20 and 22 extend into the ground for communication with the fuel tank, whether above or below ground. Additionally, these pipes may perform other functions attendant the dispensing of fuel. Dispensing handle 24 is in fluid communication with a hose 26 to convey fuel from within dispenser 10 into the fuel tank of a vehicle or other depository. A second or more handles 28 connected to respective hoses 30 also convey fuel to a vehicle or other depository. Usually, each handle provides a different grade or type of fuel. The hoses are connected to a source of fuel within dispenser 10.

Figure 2:
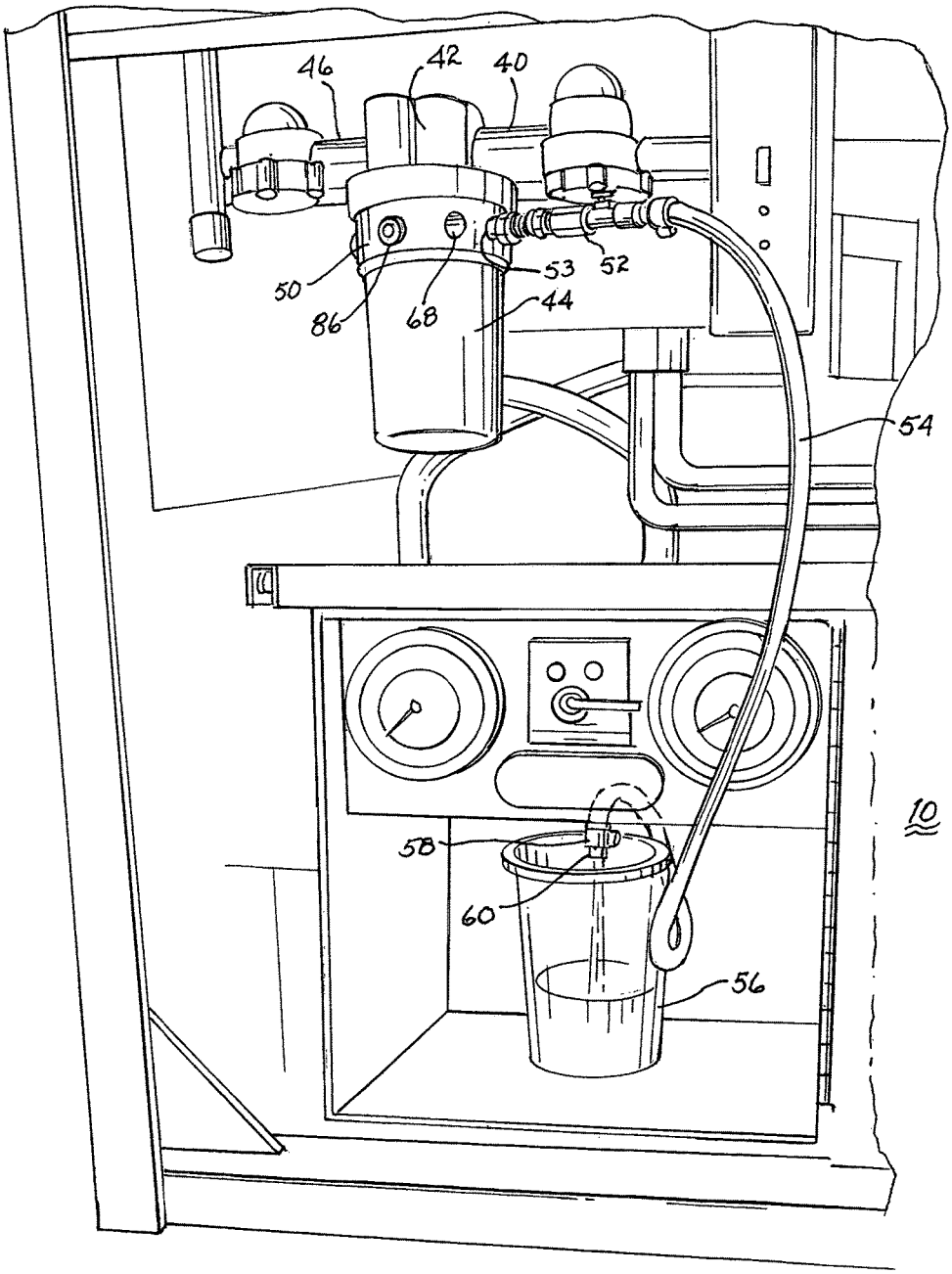
FIG. 2 illustrates the collar disposed intermediate a conventional filter mounting and a filter, along with a fuel discharge tube.

Referring jointly to FIGS. 1 and 2, a portion of dispenser 10 relevant to the present invention is illustrated in FIG. 2. Normally, a conduit 40 conveys fuel to be dispensed through a threaded coupling 42 into a conventional filter 44 and back into conduit 46 for ultimate discharge through one of the hoses (26, 30) and respective handles (24, 28). In the present invention, a collar 50 is in threaded engagement with threaded coupling 42. The collar supports filter 44 through a threaded engagement. Thereby, the filter may be periodically changed by unthreading the filter from the collar and replaced by a new filter threaded engaged with the collar. A quick disconnect fitting 52 is in threaded engagement with a threaded passageway of collar 50 and in fluid communication with the fuel in the interior of the collar. Cavities 68 and threaded plugs 86 are further shown in FIG. 6.

During testing, tubing 54 is temporarily connected with quick disconnect fitting 52 to relieve the pressure of the fuel within conduit 40. The fuel flowing through the tubing is discharged into a suitable container, such as cup 56. For safety reasons, a clamp 58 or the like may be used to secure end 60 of the tubing to the cup to prevent spillage. Once the pressure within conduit 40 has been relieved, further outflow of fuel through tubing 54 will not occur. On completion of subsequent tests to be performed, the contents of cup 56 may be returned to the main fuel tank (not shown) or other depository.

Figure 3:
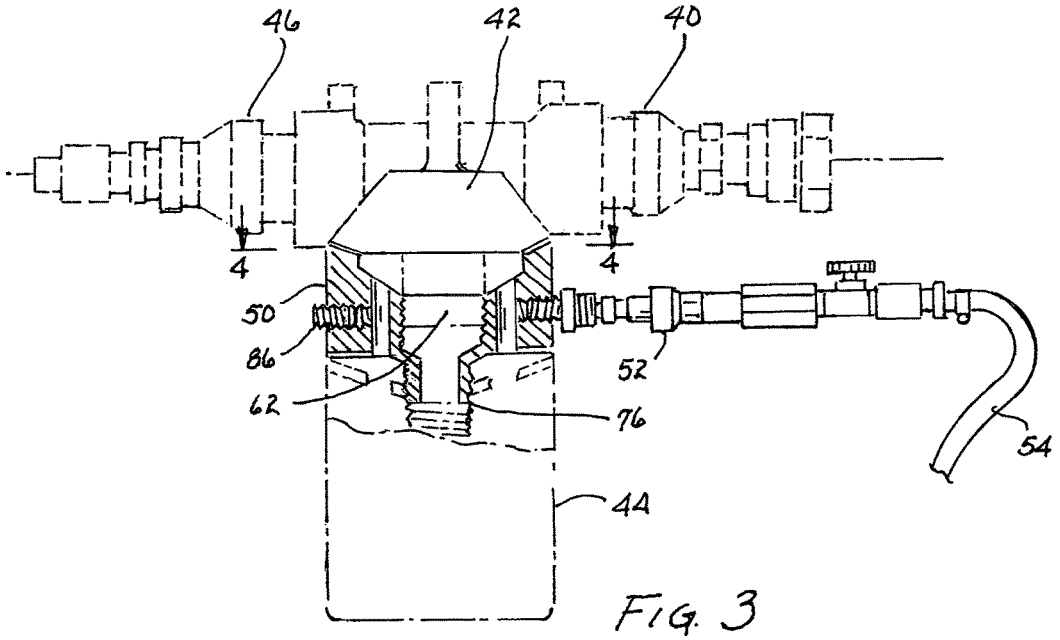
FIG. 3 illustrates a partial cross-section of the collar.
Figure 4:
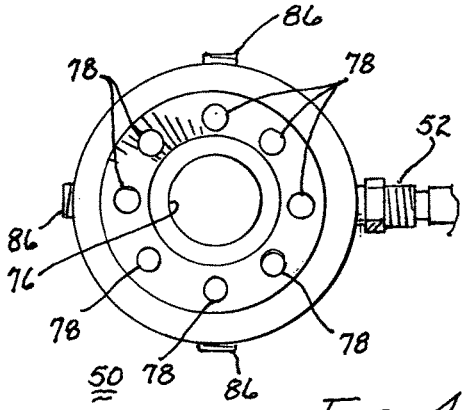
FIG. 4 is a top view of the collar taken along lines 4-4, shown in FIG. 3.
Figure 5:
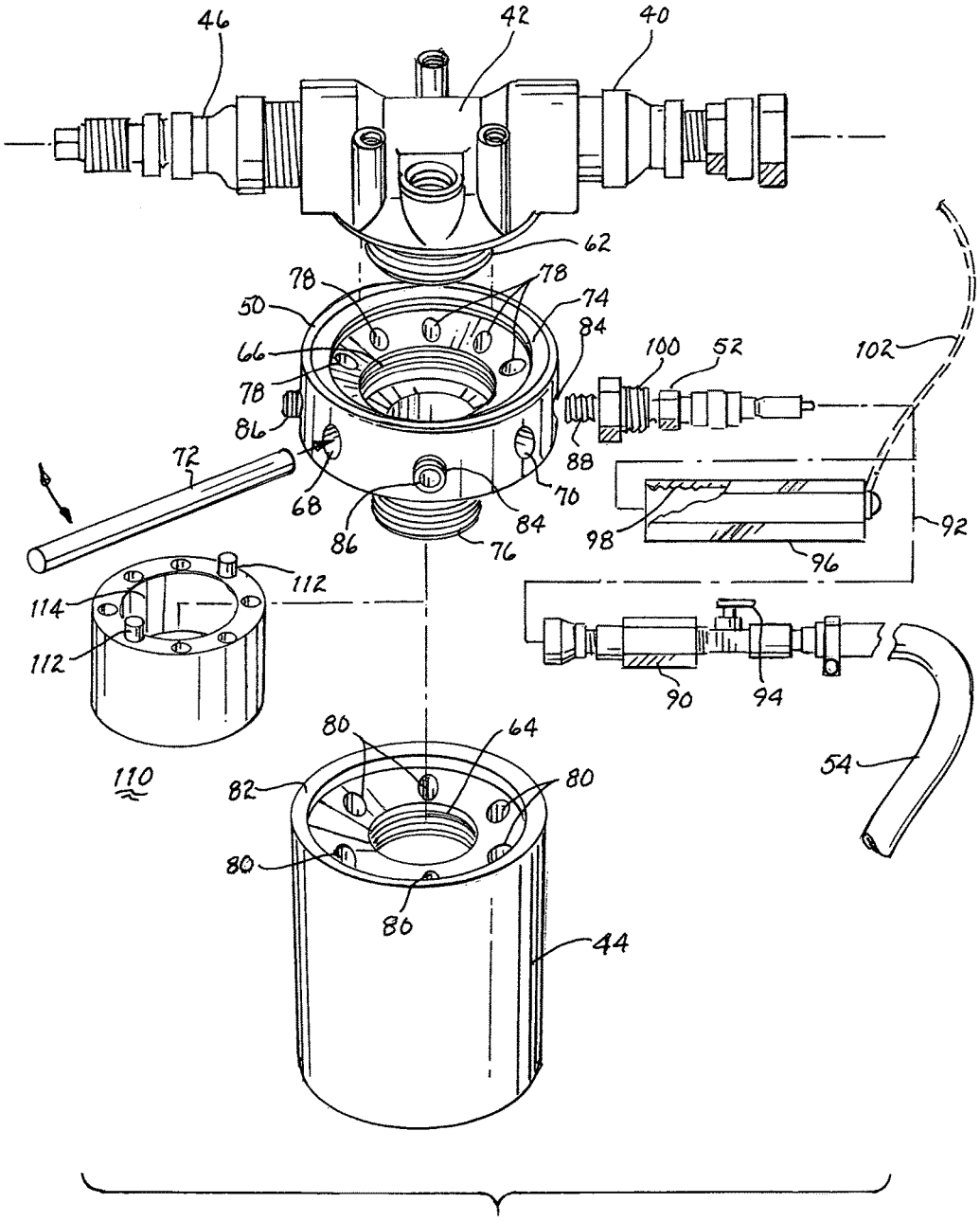
FIG. 5 is an exploded view of the components attendant the present invention.

Referring jointly to FIGS. 3,4 and 5, details attendant collar 50 will be described. Coupling 42 includes a threaded hollow boss 62 of a conventional size and thread to threadedly engage with threads 64 in filter 44. Collar 50 includes internal threads 66 for threadedly engaging hollow boss 62 to mount collar 50 onto coupling 42. The collar includes a plurality of cavities, of which cavities 68 and 70 are shown. A rod 72 may be inserted into one of the cavities to assist in stabilizing the collar during threaded attachment and detachment of filter 44. One or more seals 74 may be disposed intermediate the collar and coupling to ensure a leak-free engagement. Collar 50 includes a depending threaded hollow boss 76 for engagement with threads 64 in filter 44. A plurality of vertical passageways 78 extend through collar 50. These passageways are in fluid communication with a plurality of conventional inlets 80 disposed in filter 44. A seal 82 may be employed about the rim of the filter to ensure a leak-free fit between the filter and the collar.

In operation, fuel flowing through conduit 40 enters coupling 42 and is distributed into vertical passageways 78. The fuel then flows into filter 44 through inlets 80 and through the filter element within filter 44 to exit through hollow boss 76 and into hollow boss 62 of coupling 42. Thereafter, the fuel is channeled into conduit 46 for ultimate dispensation through one of the hoses of the dispenser and through the respective handle.

As described above, collar 50 threadedly supports a filter for the fuel to be dispensed. The collar is threadedly secured to coupling 42. Previously, only filters mating with coupling 42 could be used. The use of a collar, intermediate the coupling and the filter, permits use of a collar that is configured to threadedly engage a filter other than what would be required to mate with coupling 42. Thereby, collar 50 can be reconfigured for use in the manner of an adapter to secure various filters to the coupling.

Collar 50 includes a plurality of threaded passageways 84. Each unused ones of these through the passageways is sealed by a threaded plug 86. Quick disconnect fitting 52 includes a hollow threaded end 88 for threaded engagement with one of threaded passageways 84. Thereby, the quick disconnect fitting is in fluid communication with the interior of collar 50 and the fluid therein. The quick disconnect titling will prevent fuel flow therethrough until it is engaged by the mating half of the quick disconnect fitting.

Figure 6:
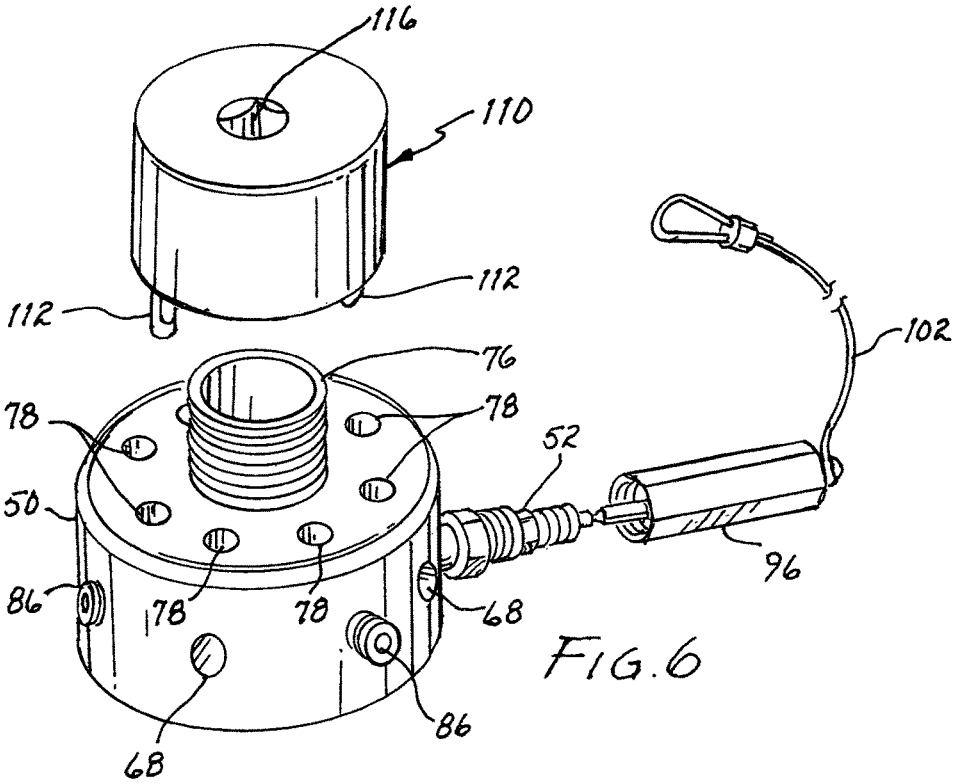
FIG. 6 is an exploded view of the collar and a fitting for threadedly securing the collar in place.

Referring to FIGS. 5 and 6, there is shown an apparatus for firmly attaching collar 50 to coupling 42. An installation tool 110 may include two or more pegs 112 extending therefrom. The installation tool includes a cavity 114 for receiving threaded hollow boss 76. Pegs 112 mate with corresponding ones of passageways 78. A socket 116 is disposed in the installation tool to permit use of a wrench to tightly secure collar 50 with coupling 42.

It is noted that rod 72 engaging a corresponding one of cavity 68 in the collar may be used to threadedly engage the collar with coupling 42. However, it is preferable to use installation tool 110 to secure the collar with the coupling. To ensure sealed engagement between filter 44 and collar 50, the rod may be used to stabilize the collar while the filter is attached and detached through use of a conventional strap wrench. Thereby, even partial disengagement of the collar from the coupling is avoided by stabilizing the coupling with rod 72 during unthreading of the filter from the collar. The quick disconnect fitting and cylinder 96 serving as a cover with attached lanyard 102 are shown in FIG. 6.

Figure 7:
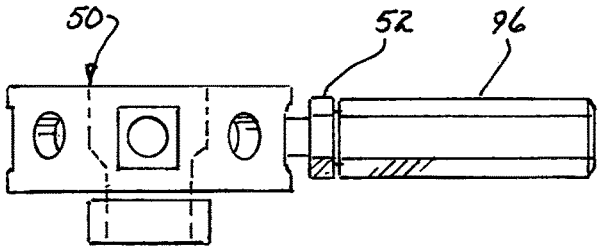
FIG. 7 illustrates the quick connect lining with a cover secured to the collar.
Figure 8A:
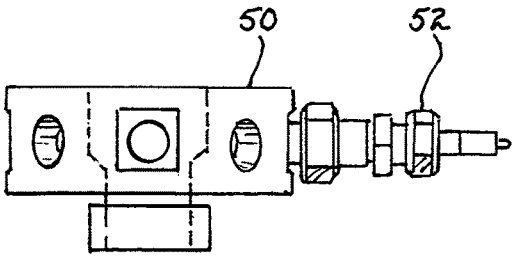
FIGS. 8A and 8B illustrate the male quick connect fitting serving as a test probe and the attachment of a female quick connect fitting supporting a drain hose.
Figure 8B:
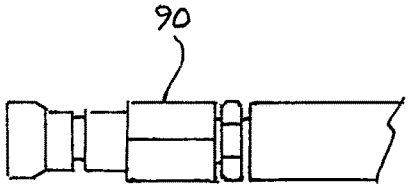

FIGS. 7, 8A and 8B are simplified figures to further show the quick disconnect fitting and its function. In particular, FIG. 7 illustrates cylinder 96 covering quick disconnect fitting 52 to protect it and to prevent contamination by dirt, etc. FIGS. 8A and 8B show quick disconnect fitting 52 with the cover removed and prior to engagement with female fitting 90.

I claim:

1. A test port for a conventional gasoline/diesel fuel dispenser having a filter detachably attachable to a hollow threaded coupling that enables testing to occur at a highline point in the line system to include all or at least more of the line system head pressure than has been previously possible, said test port comprising:

(a) a collar threadedly attachable to the threaded coupling;

(b) a filter threadedly attachable to said collar;

(c) a threaded boss depending from said collar for threadedly engaging said filter;

(d) an install tool for installing and removing said collar from said coupling; and (e) a plurality of threaded ports disposed in said collar for supporting a quick connect fitting and including a plurality of plugs for closing unused ones of said plurality of threaded ports.

2. The test port as set forth in claim 1 wherein said install tool includes at least one peg for engaging a cavity in said collar to prevent rotation of said install tool independent of rotation of said collar.

3. The test port as set forth in claim 2 wherein said install tool includes a cavity for engagement by a torque wrench to threadedly engage and disengage said collar with the threaded coupling.

4. The test port as set forth in claim 3 wherein said install tool is detachably attachable with said collar in the absence of the filter.

5. The test port as set forth in claim 1 wherein said collar includes at least one cavity for engagement by a rod to prevent rotational movement of said collar during threaded attachment and detachment of said filter.

6. The test port as set forth in claim 5 including a plurality of said cavities displaced about said coupling to ensure access by said rod irrespective of the rotational position of said collar.

7. The test port as set forth in claim 1 including a compressible seal disposed intermediate said collar and the threaded coupling.

8. The test port as set forth in claim 1 including a removable cover in threaded engagement with the quick connect fitting.

9. The test port as set forth in claim 8 including tubing detachably attachable to the quick connect fitting to drain fuel under pressure from within said collar prior to removal of said filter.

10. The test port as set forth in claim 1 wherein said collar is in the shape of an adapter to secure various filters to the coupling.

11. A test port disposed intermediate a fluid line under pressure within a conventional gasoline/diesel fuel dispenser comprising a hollow threaded coupling and a filter for filtering the fluid, said test port further comprising:

(a) a collar in threaded engagement with the threaded coupling and having an axis of rotation;

(b) said collar including at least one threaded lateral passageway;

(c) a quick connect fitting threadedly engaging said at least one threaded passageway; and (d) an hollow threaded boss extending from said collar threadedly engaging said filter.

12. The test port as set forth in claim 11 including a removable install tool having at least one peg for engaging a cavity in said collar, said install tool including an axis of rotation in alignment with the axis of rotation of said collar upon engagement and disengagement of said collar with said threaded coupling.

13. The test port as set forth in claim 12 wherein said install tool includes more than one of said pegs and said collar includes at least an equivalent number of said cavities.

14. The test port as set forth in claim 13 wherein said install tool includes a socket for engagement by a wrench.

15. The test port as set forth in claim 11 wherein said collar includes a plurality of said threaded cavities disposed about the perimeter of said collar, each of said plurality of said threaded cavities being engageable with the quick connect fitting.

16. The test port as set forth in claim 15 including a plurality of threaded plugs for sealing unused ones of said threaded cavities.

17. The test port as set forth in claim 11 including a plurality of cavities disposed about the perimeter of said collar for engagement by a rod to stabilize said collar during threaded attachment and detachment of the filter.

18. The test port as set forth in claim 11 including a seal disposed intermediate said collar and the threaded coupling.

19. The test port as set forth in claim 11 including a seal disposed intermediate said collar and the filter.

20. The test port as set forth in claim 11 including a fluid discharge tube detachably attached to said quick connect fitting for draining fluid under pressure within said collar.

21. The test port as set forth in claim 11 wherein said collar is in the shape of an adapter to secure various filters to the coupling.

22. The test port as set forth in claim 11 wherein said test port is adapted for permanent installation in the gasoline/diesel fuel dispenser.

* * * * *